US008683967B2

(12) United States Patent
Gunnel et al.

(10) Patent No.: US 8,683,967 B2
(45) Date of Patent: Apr. 1, 2014

(54) DISPLACEMENT GROOVE CONTOUR OF SLIDING CAM ASSEMBLIES OF AN INTERNAL COMBUSTION RECIPROCATING PISTON ENGINE

(75) Inventors: Ronny Gunnel, Puschendorf (DE); Linda Funke, Herzogenaurach (DE); Steffen Hein, Hirschaid (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 52 days.

(21) Appl. No.: 13/534,411

(22) Filed: Jun. 27, 2012

(65) Prior Publication Data

US 2013/0032111 A1 Feb. 7, 2013

(30) Foreign Application Priority Data

Aug. 2, 2011 (DE) ..... 10 2011 080 267

(51) Int. Cl.
*F01L 1/34* (2006.01)

(52) U.S. Cl.
USPC ..... 123/90.17; 123/90.15

(58) Field of Classification Search
USPC ..... 123/90.15, 90.16, 90.18, 90.17, 90.6
See application file for complete search history.

(56) References Cited

U.S. PATENT DOCUMENTS

2007/0034184 A1* 2/2007 Dengler ..... 123/90.17

FOREIGN PATENT DOCUMENTS

DE 102004008670 9/2005

* cited by examiner

*Primary Examiner* — Zelalem Eshete
(74) *Attorney, Agent, or Firm* — Volpe and Koenig, P.C.

(57) ABSTRACT

Engine with a crank mechanism and a cylinder head whose intake and exhaust channels are regulated by gas exchange valves activated by cams of at least one camshaft. The cams are sliding cams with at least one cam per sliding cam assembly arranged rotationally fixed but axially displaceable on a base shaft, and each having an actuator with an actuator pin for displacing the sliding cam assemblies into different axial positions via at least one displacement groove which cooperates with the pin. The displacement groove being helical shaped and having a run-in and a run-out region for the pin and a displacement flank and an opposing support flank. A detent device locks the sliding cam assemblies in different axial positions. A distance between the displacement flank and the support flank remains constant along the entire extent of the displacement groove parallel to the displacement direction of the sliding cam assembly.

10 Claims, 1 Drawing Sheet

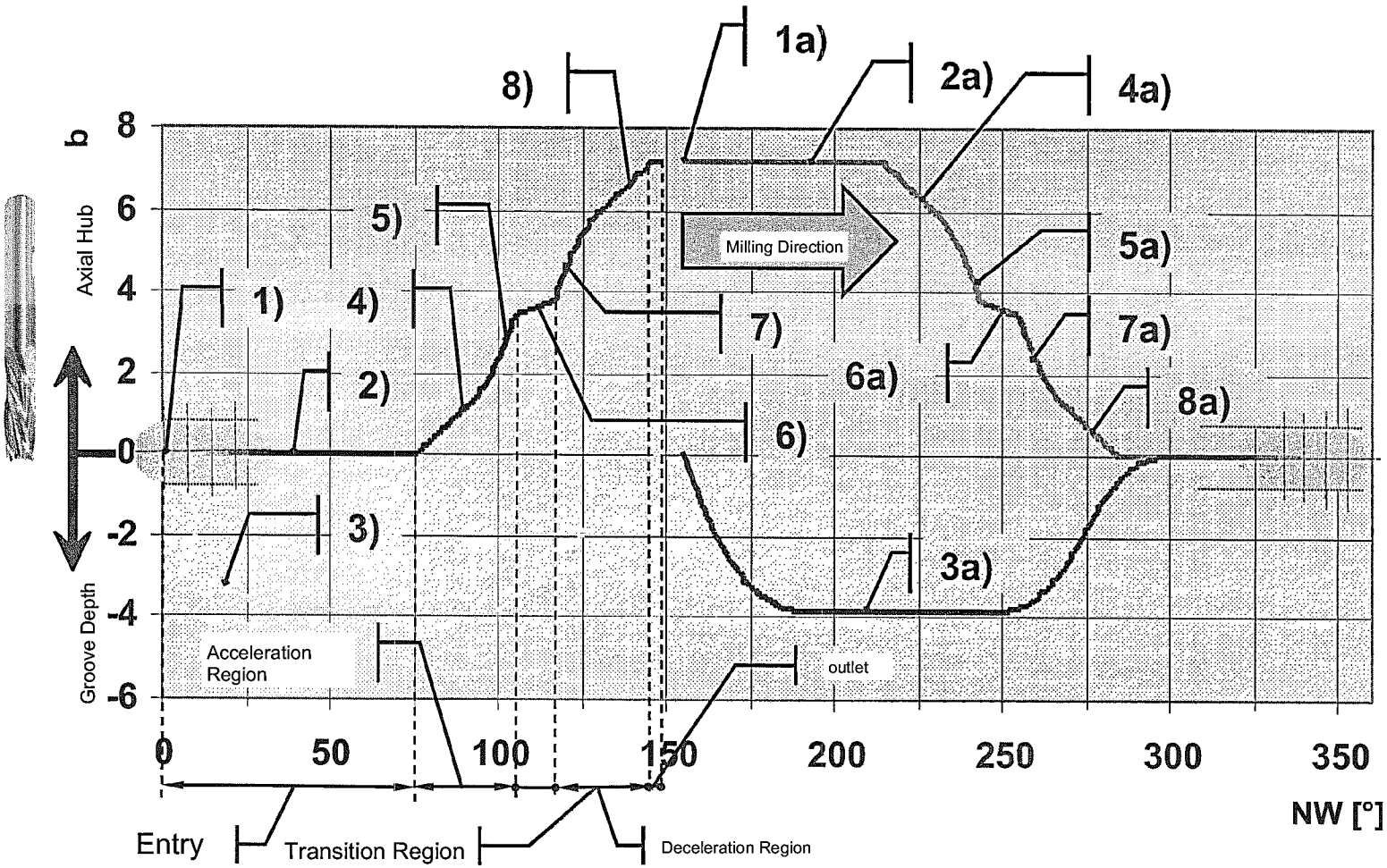
b
Axial Hub
Groove Depth
8
6
4
2
0
-2
-4
-6
0
50
100
150
200
250
300
350
NW [°]
Entry
Transition Region
Deceleration Region
Acceleration Region
Milling Direction
outlet
1)
2)
3)
4)
5)
6)
7)
8)
1a)
2a)
3a)
4a)
5a)
6a)
7a)
8a)

DISPLACEMENT GROOVE CONTOUR OF SLIDING CAM ASSEMBLIES OF AN INTERNAL COMBUSTION RECIPROCATING PISTON ENGINE

CROSS-REFERENCE TO RELATED APPLICATIONS

This application claims the benefit of German Patent Application No. 10 2011 080 267.3, filed Aug. 2, 2011, which is incorporated herein by reference as if fully set forth.

FIELD OF THE INVENTION

An internal combustion reciprocating piston engine comprising a crank mechanism having at least one cylinder head whose intake and exhaust channels are regulated, each one, by at least one gas exchange valve configured as an intake and exhaust valve which can be activated by cams of at least one camshaft and by transmission elements driven by said cams, said cams being configured as sliding cams with at least one cam per sliding cam assembly while being arranged fixed against rotation but axially displaceable on a base shaft, said base shaft being guided, fixed on the internal combustion engine and comprising at least one actuator unit fixed on the internal combustion engine and comprising at least one actuator pin for displacing said sliding cam assemblies into different axial positions with help of at least one displacement groove which cooperates with said actuator pin, said displacement groove being arranged on a periphery of said sliding cam assemblies or on a periphery of a component which is fixed on said sliding cam assembly, said displacement groove being configured with a helical shape and comprising a run-in region and a run-out region for said actuator pin and also a displacement flank and an opposing support flank, said engine further comprising a detent device for locking the sliding cam assemblies in said different axial positions relative to a component fixed on the internal combustion engine.

BACKGROUND OF THE INVENTION

Sliding cam assemblies of the above-noted type comprising displacement grooves as part of a camshaft for internal combustion reciprocating piston engines are known from DE-10 2004 008 670 A1. The displacement grooves in this case comprise lateral displacement flanks and opposing support flanks between which the actuator pin engages and displaces the sliding cam assembly in correspondence to the displacement contour on the displacement flank and the counter contour on the support flank and, again, decelerates the movement of displacement. The width of the run-in region for the actuator pin is chosen such that, taking into account the different tolerances between the actuator pin and the displacement groove, the actuator pin can always penetrate into the displacement groove. Directly following the run-in region, the displacement groove becomes narrower and narrower till it substantially equals the diameter of the actuator pin. Such displacement grooves are realized in that two milling operations with two mill running paths are performed, one of the mill running paths producing the run-in region with support flank as well as the run-out region, while the second one of the mill running paths produces the opposing flank of the run-in region, the support flank and the opposing side of the run-out region.

It is only in the direct displacement region that the two mill running paths are situated practically on top of each other. This means that high production costs for milling the displacement groove or grooves with help of two mill running paths extending over an angle of 360° are incurred.

In addition, high negative acceleration forces occur during deceleration of the actuator pin on the support flank.

SUMMARY

The object of the invention is to improve the displacement groove so that it can be produced in a considerably more economic manner. In addition, the contact forces occurring between the displacement and support flanks and the actuator pin in the acceleration and deceleration regions should be situated, at the most, at the hitherto usual level, but preferably at a considerably lower level.

The invention achieves the above object by the fact that the distance between the displacement flank and the support flank remains constant along the entire extent of the displacement groove parallel to the direction of displacement of the sliding cam assembly.

In this way, the displacement groove can be produced in a single mill running path which leads to a considerable reduction of manufacturing costs. The distance between the flanks of the displacement groove is matched to the width of the run-in region, said width being chosen such that the actuator pin, taking into account the maximum tolerances between the displacement groove and the actuator pin, reaches the run-in region of the displacement groove. As a result, a displacement groove is produced that corresponds to the width of the run-in region and this width remains constant, which naturally means that a milling cutter with a larger thickness than in the prior art is used. Thus, the displacement groove can be made with help of a milling cutter, particularly an end-milling cutter, in a single milling operation. This also applies to all types of displacement grooves on the periphery of a sliding cam assembly, for example a double S-groove or a Y-groove. Moreover, all the displacement grooves of all the sliding cam assemblies of a camshaft, e.g. of an internal combustion engine, are made in this way, so that a considerable overall saving is achieved.

According to a further development of the invention, the displacement groove following immediately after the run-in region comprises, without an gradient, an acceleration region, a transition region and a deceleration region. The acceleration region includes an acceleration ramp and an adjoining acceleration flank, while the deceleration region comprises a deceleration flank and an adjoining deceleration ramp. The acceleration flank has a larger gradient than the acceleration ramp, while the deceleration ramp has a smaller gradient than the preceding deceleration flank, said gradients being measured relative to the respective cross-sectional plane of the sliding cam assembly starting from the run-in region. Depending on the speed of rotation of the reciprocating piston engine, a free flight phase of the sliding cam assembly relative to the stationary actuator pin occurs in the transition region between the acceleration flank and the deceleration flank, so that an alternation of contact of the actuator pin between the displacement flanks and the support flanks results. However, by an optimization of the acceleration flanks, a maximum differential speed of no more than 2.5 m/sec is produced between the actuator pin and the sliding cam assembly at an engine speed of, for example, 4000 rpm, so that the resulting deceleration forces on the opposing deceleration flank are significantly reduced to values below 700 N.

At low speeds of rotation of the sliding cam assembly, no free flight phase occurs, so that the alternation of contact on the opposing support flank takes place only when the locking device has snapped in.

The gradient of the acceleration ramp has been optimized such that, at higher speeds of rotation of the internal combustion reciprocating piston engine, the deceleration forces acting on the actuator pin are substantially reduced.

BRIEF DESCRIPTION OF THE DRAWINGS

For further elucidation of the invention, reference should be made to the appended drawings in which one exemplary of embodiment of the invention is shown in a simple representation.

FIG. 1 shows: the schematic course of the mill running path for producing two displacement grooves of a sliding cam assembly arranged one behind the other, the upper curves representing the course of the mill running path along the periphery of the displacement groove, and the lower paths representing the depth of milling in radial direction relative to the sliding cam assembly.

DETAILED DESCRIPTION OF THE PREFERRED EMBODIMENT

Mill running paths shown in FIG. 1 describe the course of a double S-groove. Shown are two displacement grooves 1 and 1*a* that describe the entire periphery of 360° of an outer shell of a sliding cam assembly. The displacement grooves 1, 1*a* comprise run-in regions 2 and 2*a* for an actuator pin, not represented. The large width of the run-in regions 2 and 2*a* serve to compensate for positional errors between the actuator pin and the displacement grooves 1, 1*a* resulting from manufacturing tolerances and thermal expansion of the different materials. The run-in regions 2 and 2*a* further serve, as can be seen from the depth curves 3 and 3*a*, to allow the actuator pin to run into the groove bottom. The run-in regions 2 and 2*a* of the displacement grooves 1, 1*a* which are made without a gradient relative to the cross-sectional plane of the sliding cam assembly, are adjoined by an acceleration region having an acceleration ramp 4 and 4*a*. The acceleration ramp 4, 4*a* that, at first, has a flat shape, i.e. a small gradient of an angle of ca. 45°, serves to eliminate all lashes between the actuator pin and the displacement flank of the displacement grooves 1 and 1*a*. In correspondence to the actual lash existing between the actuator pin and the displacement flank, the sliding cam assembly is already slightly accelerated when the lash is small, whereas with a larger lash, the acceleration ramp 4 and 4*a* serves almost completely to adjust lash. After all lashes have been adjusted, the steeper acceleration ramp 5 and 5*a* starts with a gradient of an angle of about 67° which accelerates the sliding cam assembly more strongly and permits a jumping of the locking device out of the fixed position. The acceleration flanks 5 and 5*a* of the displacement grooves 1 and 1*a* are adjoined by transition regions 6 and 6*a* which have a gradient of an angle of ca. 22° and in which free flight phases may occur depending on the speed of rotation. Through the optimization of the acceleration ramps, the maximum speed of the sliding cam assembly during the free flight phase is reduced by about 35%. This leads to almost a halving of the deceleration force required in the range of 4000 rpm of the internal combustion reciprocating piston engine. At low speeds of rotation, due to the too slight acceleration of the sliding cam assembly, no free flight occurs in the transition regions 6 and 6*a*, so that flank alternation between the displacement flank and the support flank takes place only when the locking device has snapped into the neighboring position. The transition regions 6 and 6*a* are adjoined by deceleration regions with deceleration flanks 7 and 7*a* as also deceleration ramps 8 and 8*a*. The at first flat deceleration flanks 7 and 7*a* with a gradient of an angle of about 65° serve for a gentle seating of the actuator pin on the support flank of the displacement grooves 1 and 1*a* after the displacement step. Immediately following the flat region, the deceleration flank merges into the deceleration ramps 8 and 8*a* with a gradient of an angle of about 42° to assure a constant, defined speed (the acceleration now is zero) of the sliding cam assembly over the entire tolerance range and to permit a snapping-in of the locking device under all tolerance conditions. As already mentioned in the general description, the aforesaid angles relate to a cross-sectional plane of the sliding cam assembly starting from the run-in region.

The run-out region, visible at the ends of the depth curves 3 and 3*a*, in which the depth again approximates the outer periphery of the sliding cam assembly, serves for a controlled exit of the actuator pin out of the displacement grooves 1 and 1*a* to thus enable a secure fixing of the actuator pin in the actuator assembly at the end of the run-out ramp.

LIST OF REFERENCE NUMERALS

1, 1*a* Displacement grooves
2, 2*a* Run-in regions
3, 3*a* Depth curves
4, 4*a* Acceleration ramps
5, 5*a* Acceleration flanks
6, 6*a* Transition phases
7, 7*a* Deceleration flanks
8, 8*a* Deceleration ramps

The invention claimed is:

1. An internal combustion reciprocating piston engine comprising a crank mechanism having at least one cylinder head whose intake and exhaust channels are regulated, each one, by at least one gas exchange valve configured as an intake or an exhaust valve which can be activated by cams of at least one camshaft and by transmission elements driven by said cams, said cams being configured as sliding cams with at least one cam per sliding cam assembly while being arranged fixed against rotation but axially displaceable on a base shaft, said base shaft being guided, fixed on the internal combustion engine and comprising at least one actuator unit fixed on the internal combustion engine and comprising at least one actuator pin for displacing said sliding cam assemblies into different axial positions with help of at least one displacement groove which cooperates with said actuator pin, said displacement groove being arranged on a periphery of said sliding cam assemblies or on a periphery of a component which is fixed on said sliding cam assembly, said displacement groove being configured with a helical shape and comprising a run-in region and a run-out region for said actuator pin and also a displacement flank and an opposing support flank, said engine further comprising a detent device for locking the sliding cam assemblies in said different axial positions relative to a component fixed on the internal combustion engine, and a distance between the displacement flank and the support flank remains constant along an entire extent of the displacement groove parallel to a direction of displacement of the sliding cam assembly.

2. An internal combustion reciprocating piston engine according to claim 1, wherein the distance between the displacement flank and the support flank corresponds to a width of the run-in region, said width being chosen such that the actuator pin, taking into account a maximum tolerances between the displacement groove and the actuator pin, reaches the run-in region of the displacement groove.

3. An internal combustion reciprocating piston engine according to claim 1, wherein the displacement groove is made using a milling cutter in a single milling operation.

4. An internal combustion reciprocating piston engine according claim 1, wherein all of the displacement grooves of the sliding cam assembly or sliding cam assemblies of a camshaft or all camshafts of an internal combustion reciprocating piston engine are made using a milling cutter of an equal dimension.

5. An internal combustion reciprocating piston engine according claim 1, wherein the displacement groove comprises, following the run-in region, an acceleration region, a transition region comprising a rotational speed dependent free flight phase and a deceleration region.

6. An internal combustion reciprocating piston engine according claim 5, wherein the deceleration region comprises an acceleration ramp and, adjoining said ramp, an acceleration flank.

7. An internal combustion reciprocating piston engine according claim 6, wherein the deceleration region comprises a deceleration flank and, adjoining said flank, a deceleration ramp.

8. An internal combustion reciprocating piston engine according claim 7, wherein the acceleration ramp possesses a larger gradient and the deceleration ramp possesses a smaller gradient than a respective preceding section, said gradients being defined relative to a respective cross-sectional plane of the sliding cam assembly starting from a run-in region.

9. An internal combustion reciprocating piston engine according claim 8, wherein the transition region possesses a constant gradient.

10. An internal combustion reciprocating piston engine according claim 9, wherein the transition region possesses a substantially smaller gradient than the acceleration region and the deceleration region, and a length of the transition region is dimensioned such that, at higher speeds of rotation of the internal combustion reciprocating piston engine, a free flight phase of the sliding cam assembly is produced.

* * * * *